US008490316B2

(12) United States Patent
Kincel et al.

(10) Patent No.: US 8,490,316 B2
(45) Date of Patent: Jul. 23, 2013

(54) FLASHLIGHT HOLDER FOR A FIREARM

(75) Inventors: Eric Stephen Kincel, Tucson, AZ (US); Christopher James Hendryk, Tucson, AZ (US)

(73) Assignee: Abrams Airborne Manufacturing Inc., Tucson, AZ (US)

( * ) Notice: Subject to any disclaimer, the term of this patent is extended or adjusted under 35 U.S.C. 154(b) by 0 days.

(21) Appl. No.: 13/373,022

(22) Filed: Nov. 2, 2011

(65) Prior Publication Data

US 2013/0104441 A1 May 2, 2013

(51) Int. Cl.
*F41G 1/38* (2006.01)

(52) U.S. Cl.
USPC ..... 42/124; 42/125; 42/126; 42/127

(58) Field of Classification Search
USPC ..... 42/124–127, 148, 114–115, 90, 136; 362/110
See application file for complete search history.

(56) References Cited

U.S. PATENT DOCUMENTS

| | | | | |
|---|---|---|---|---|
| 7,841,120 | B2 * | 11/2010 | Teetzel et al. | 42/72 |
| 7,870,689 | B2 * | 1/2011 | Dextraze | 42/126 |
| 7,941,960 | B2 * | 5/2011 | Matthews et al. | 42/90 |
| 7,954,971 | B1 * | 6/2011 | Kincaid et al. | 362/110 |
| 7,975,419 | B2 * | 7/2011 | Darian | 42/84 |
| 2007/0266612 | A1 * | 11/2007 | Kim | 42/127 |
| 2010/0122485 | A1 * | 5/2010 | Kincel | 42/146 |

* cited by examiner

*Primary Examiner* — John W Eldred
*Assistant Examiner* — Benjamin Gomberg
(74) *Attorney, Agent, or Firm* — Mark Ogram

(57) ABSTRACT

A clamp used to attach a flashlight to a firearm having a rail thereon. In the preferred embodiment, the clamp utilizes a sleeve configured to accept a handle of the flashlight. The sleeve has at least one tooth configured to engage the rail on the firearm. A wedge is movably secured to the sleeve such that a simultaneous action by the operator both forces the wedge up a ramp on an interior aspect of the clamp and secures the clamp by compressing the rail between a bracket (which engages both the clamp and the rail) and the tooth on the sleeve.

15 Claims, 3 Drawing Sheets

FLASHLIGHT HOLDER FOR A FIREARM

BACKGROUND OF THE INVENTION

This invention relates generally to firearms and more particularly to holders or clamps used to secure flashlights or other accessories to the firearm.

Flashlights and laser aiming mechanisms are often secured to a firearm to assist in low light environments and to provide pin-point sighting of the weapon. Often these devices are affixed to a mounting rail for easy attachment and detachment of the flashlight. Such rails are well known to those of ordinary skill in the art and include those described in U.S. Pat. No. 7,975,419, entitled "Mounting Rail" issued Jul. 12, 2011, to Darian; U.S. Pat. No. 7,870,689, entitled "Mount for Firearms" issued Jan. 18, 2011, to Dextraze; and, U.S. Pat. No. 7,954,971, entitled "Offset Mountable Light Accessory" issued to Kincaid et al. on Jun. 7, 2011; all of which are incorporated hereinto by reference.

These rail mechanisms allow a variety of different apparatus to be easily attached to the firearm such as handgrips as described in U.S. Pat. No. 7,841,120, entitled "Hand Grip Apparatus for Firearm" issued Nov. 30, 2010, to Teetzel et al., incorporated hereinto by reference.

In the situation where a flashlight is secured to the firearm, the barrel shaped grip of the flashlight is secured into a clamping mechanism after the mount has been secured to the firearm. This is a two-step process; (1) secure the mount to the firearm; then, (2) secure the flashlight to the mount via the clamp. Alternatively, the flashlight is semi-permanently attached to the clamping mechanism and then the clamping mechanism is secure to the firearm. Obviously this is time consuming and cumbersome. In similar fashion, removal of the flashlight typically requires the second step of removing the mounting mechanism from the rail as well.

Another problem encountered with the existing flashlight clamping mechanisms is that the clamp is typically engineered for a single sized diameter flashlight. Even small adjustments to the barrel's diameter requires a whole new clamping mechanism which is both costly and confusing as a user may be required to have several mounting clamps, each adapted to fit differing flashlights.

It is clear there is a need for an improved flashlight holder attachable to firearms.

SUMMARY OF THE INVENTION

The invention provides a versatile flashlight clamp for a firearm which allows the clamp to address differing sized flashlight handles and single step installation with simultaneous securing of the flashlight.

The invention is a clamp used to attach a flashlight to a firearm having a rail thereon. In this context, a "rail" is a fixture secured to the firearm which uses two channels along its edges, thereby permitting a fixture to be affixed to the rail by compression/pinching the two channels. As noted above, those of ordinary skill in the art readily recognize a variety of such rails as used in this context.

In the preferred embodiment, the clamp utilizes a generally circular hollow sleeve configured to accept a handle of the flashlight. The sleeve includes at least one tooth configured to engage one side of the rail on the firearm. The sleeve has an internal diameter which permits the handle/barrel of the flashlight to be readily inserted thereinto.

In the preferred embodiment of the invention, the clamp includes a generally circular hollow sleeve adapted to totally encircle the barrel of the flashlight; in some embodiments of the invention the sleeve dos not encircle the barrel, rather the sleeve uses fingers which do not totally encircle the barrel; rather, the fingers do not meet at the top of the sleeve and are used to "grip" the barrel when secured as indicated below.

A wedge is movably secured to the clamp and is free to travel up a ramp within the sleeve.

Simultaneously, the action of securing the clamp to the rail both forces the wedge up the ramp on an interior aspect of the sleeve, and secures the clamp to the rail by compressing the rail between a bracket (which engages both the clamp and the rail) and the tooth on the sleeve.

The bracket is configured to engage both the groove on the sleeve and a second side of the rail on the firearm.

In use, a tightening mechanism simultaneously forces the wedge up the ramp, and, compresses the rail between the bracket and the at least one tooth.

The ideal tightening mechanism has a rod member with one end secured to the wedge; the opposing end of the rod member extends through the bracket, and, a thumb nut is used to tightened the assembly. This forces the wedge up the ramp and compresses the tooth and bracket against the rail.

Another embodiment of the invention utilizes a cam type lever to tighten the rod by shortening it's effective length and compress the rail between the tooth and bracket. One such cam member is described in U.S. Pat. No. 7,941,960, entitled "Rail Clamp Mount" issued to Matthews et al. on May 17, 2011; incorporated hereinto by reference.

The invention, together with various embodiments thereof, will be more fully explained by the accompanying drawings and the following description thereof.

DRAWINGS IN BRIEF

DRAWINGS IN DETAIL

Figure 1:
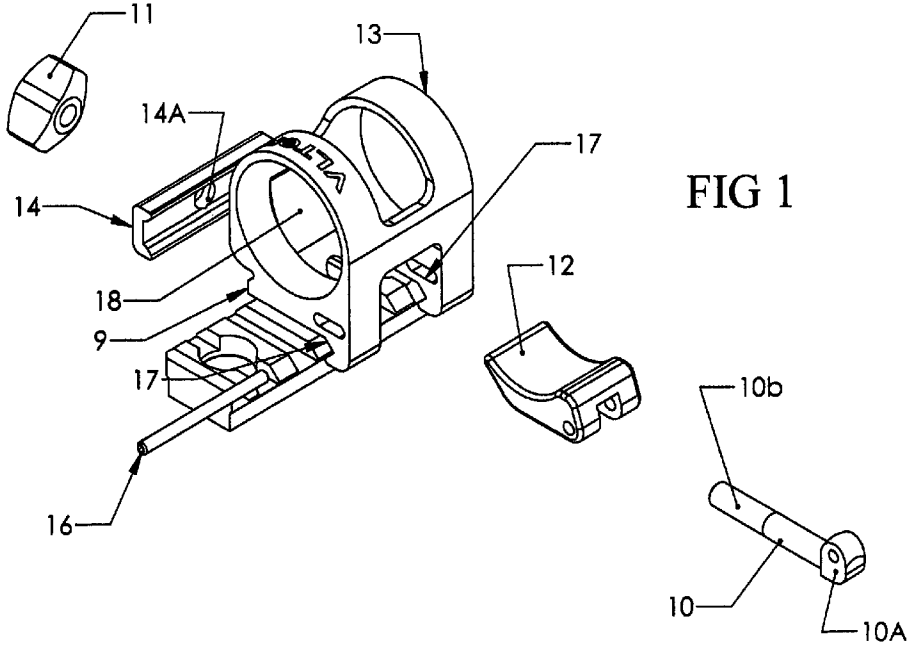
FIG. 1 is blow-up of the preferred embodiments showing the components thereof.

FIG. 1 is blow-up of the preferred embodiments showing the components thereof.

The clamp includes a sleeve 13 which is generally circular and hollow. The sleeve is configured to accept the handle/barrel of the flashlight (not shown). In this embodiment, two teeth 15 are part of the clamp and are configured to engage the rail (not shown). This embodiment uses two slots 17.

Wedge 12 has pins 16 which are configured to fit, when fully assembled, into slots 17. Wedge 12 is shaped to move along ramp 18 during the tightening of the fully assembled clamp to the rail.

Rod 10 is threaded at one end 10B and has an opening 10A at the opposing end. Opening 10A, when the clamp is assembled, is secured to wedge 12 at opening 19. End 10B of rod 10 extends through hole 14A of bracket 14. Thumb nut 11 is threaded onto end 10B.

Bracket 14 is shaped to engage groove 9, and when assembled, and also engages the rail.

Figure 2:
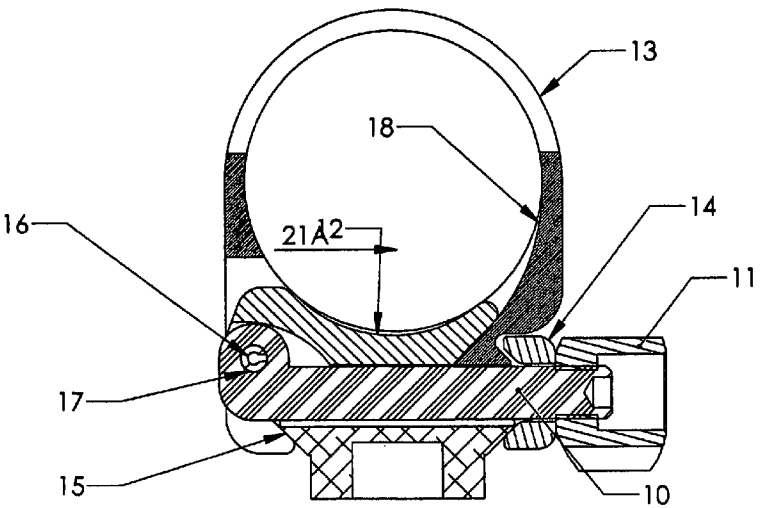
FIG. 2 is an assembled view of the preferred embodiment.

FIG. 2 is an assembled view of the preferred embodiment.

The assembled unit places wedge 12 partially inside sleeve 13 such that an end of wedge 12 engages ramp 18. Sleeve 13 is slideably secured to wedge 12 via slot 17 and pin 16.

Rod 10 is secured to wedge 12 via pin 16 at one end. Thumb nut 11 is threaded onto the other end of rod 10. Rod 10 passes through bracket 14.

As thumb nut 11 is tightened on rod 10, movement as indicated by arrow 21B occurs causing two simultaneous actions to occur: Rail 22 is pinched between tooth 15 and bracket 14; and, wedge 12 moves in the direction of arrow 21A along ramp 18 to decrease the effective diameter of sleeve 13.

In this manner, the two actions tighten the flashlight barrel (not shown) into sleeve 13, and the clamp is secured to the rail.

Figure 3A:
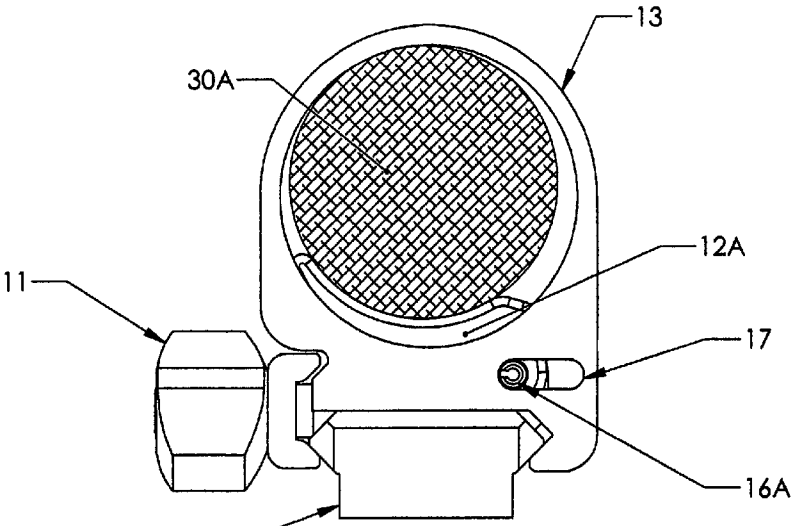
FIGS. 3A and 3B illustrate the operation of the wedge/ramp working on differing diameter barrels for a flashlight.
Figure 3B:
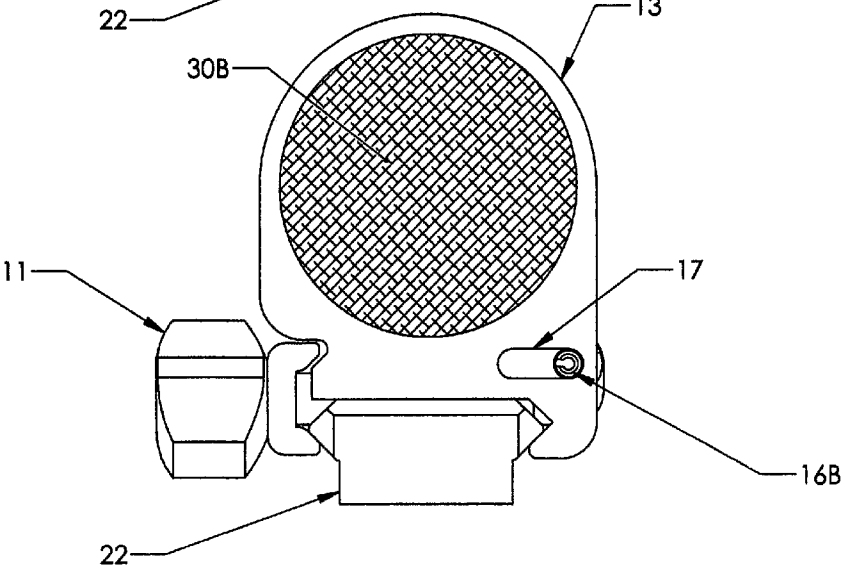

FIGS. 3A and 3B illustrate the operation of the wedge/ramp working on differing diameter barrels of a flashlight.

Note that the diameter of the barrel 30A is smaller than that of barrel 30B. The present invention is able to address both diameters by the amount that the effective diameter of hollow sleeve 13 is decreased.

In FIG. 3A, where the diameter of barrel 30A is the smallest, wedge 12A is forced up the ramp to create a smaller effective diameter for sleeve 13.

Compared to FIG. 3B, the wedge is not even visible since the diameter of barrel 30B is greater than barrel 30A.

The movement of the wedge is also indicated by the amount of contraction experienced as evidenced by the position of pin 16A in slot 17 (where there is more movement to press wedge 12A up the ramp) compared to pin 16B in slot 17 (where there is little movement of the wedge).

Figure 4:
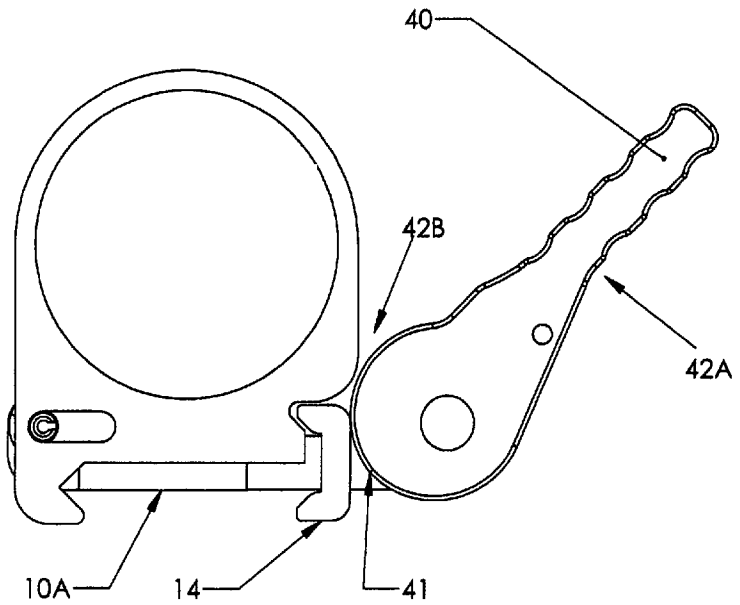
FIG. 4 illustrates an embodiment of the invention utilizing a lever/cam mechanism for the tightening the assembly to a rail.

FIG. 4 illustrates an embodiment of the invention utilizing a lever/cam mechanism for the tightening the assembly to a rail.

In this embodiment, the thumb nut of the prior embodiments is replaced by lever 40 which utilizes cam 41. As the operator presses lever 40, as indicated by arrow 42A, cam 41 moves as indicated by arrow 42B to engage bracket 14. Cam 41 in this manner, shortens the overall effective length of rod 10A to accomplish the objectives outlined above.

Figure 5:
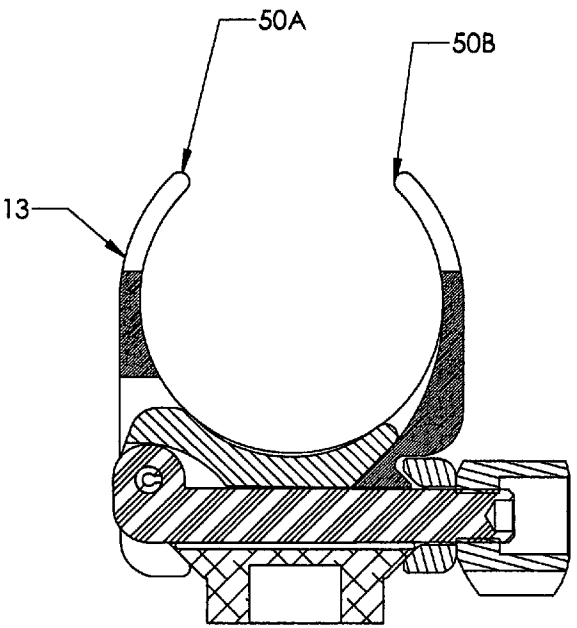
FIG. 5 illustrates an alternative embodiment which uses an open sleeve.

FIG. 5 illustrates an alternative embodiment which uses an open sleeve.

In this embodiment, sleeve 13 uses two partial rings 50A and 50B to form a grasping sleeve. The grasping sleeve operates in the same manner outlined above with the wedge and ramp.

It is clear the present invention provides a highly improved flashlight holder attachable to firearms.

What is claimed is:

1. A clamp used to attach a flashlight to a firearm having a rail thereon, said clamp comprising:

a) a generally circular hollow sleeve configured to accept a handle of the flashlight therein, said generally circular hollow sleeve having a ramp therein, said generally circular hollow sleeve containing at least one tooth configured to selectively engage a first side of the rail on the firearm, and a groove;

b) a wedge movably secured to said generally circular hollow sleeve, said wedge positioned to move up the ramp in the said generally circular hollow sleeve to reduce a diameter of generally circular hollow sleeve as said wedge is moved relative to the generally circular hollow sleeve;

c) a bracket configured to engage the groove on said generally circular hollow sleeve and a second side of the rail on the firearm; and, d) a tightening mechanism having at least one rod member, a first end of the at least one rod member secured to the wedge, a second end of said at least one rod member extending through the bracket, the second end of said at least one rod member having a tightening mechanism such that, upon engagement of the tightening mechanism, simultaneously, 1) said wedge is forced to travel up the ramp, and, 2) said rail is compressed between the bracket and the at least one tooth.

2. The clamp according to claim 1, wherein a) said at least one rod member is a single rod, the second end of the single rod being threaded; and b) said tightening mechanism is a nut mechanism secured to the second end of said single rod.

3. The clamp according to claim 1, wherein said tightening mechanism is a lever having a cam pressing against said bracket such that operator activation of the lever causes the bracket to move away from the second end of the at least one rod member.

4. The clamp according to claim 2, wherein a) said generally circular hollow sleeve includes a first and second slot therein; and, b) said wedge includes, 1) a first pin secured to the wedge at a first end of the first pin and a second end of the first pin being contained within said first slot in the generally hollow sleeve, and, 2) a second pin secured to the wedge at a first end of the second pin and a second end of the second pin being contained within said second slot in the generally hollow sleeve.

5. The clamp according to claim 4, wherein the first and second slots are positioned parallel to each other.

6. The clamp according to claim 5, wherein the first and second slots extend through a portion of said generally circular hollow sleeve.

7. A clamp used to attach a barreled apparatus to a firearm having a rail thereon, said clamp comprising:

a) a sleeve configured to accept a handle of the barreled apparatus therein, said sleeve having, 1) a ramp therein, 2) at least one tooth configured to selectively engage a first side of the rail on the firearm, and, 3) a groove;

b) a wedge movably secured to said sleeve, said wedge positioned to slide up the ramp in the said sleeve to reduce a diameter of the sleeve as said wedge is moved up said ramp;

c) a bracket configured to engage the groove on said sleeve and a second side of the rail on the firearm; and, d) a tightening mechanism adapted to simultaneously, 1) force said wedge to travel up the ramp, and, 2) compress said rail between the bracket and the at least one tooth.

8. The clamp according to claim 7, wherein the tightening mechanism includes, a) a rod member, a first end of the rod member connected to the generally circular bracket, the second end of the single rod being threaded; and b) a nut secured to the second end of said rod member.

9. The clamp according to claim 8, wherein a) said sleeve includes a first and second slot therein; and, b) said wedge includes, 1) a first pin secured to the wedge at a first end of the first pin and a second end of the first pin being slidably contained within said first slot in the sleeve, and, 2) a second pin secured to the wedge at a first end of the second pin and a second end of the second pin being slidably contained within said second slot in the sleeve.

10. The clamp according to claim 9, wherein the first and second slots are positioned parallel to each other.

11. The clamp according to claim 10, wherein the first and second slots extend through a portion of said sleeve.

12. A clamp used to attach a flashlight to a firearm having a rail thereon, said clamp comprising:

a) a grasping sleeve configured to accept a handle of the flashlight therein, said grasping sleeve having a ramp therein, at least one tooth configured to selectively engage a first side of the rail on the firearm, and a groove;

b) a wedge movably secured to said grasping sleeve, said wedge positioned to move against the ramp in the said grasping sleeve and thereby reduce a diameter of the grasping sleeve;

c) a bracket configured to engage the groove on said grasping sleeve and a second side of the rail on the firearm; and, d) a tightening mechanism adapted to simultaneously, force said wedge to move against the ramp, and compress the rail between the bracket and the at least one tooth.

13. The clamp according to claim 12, wherein said tightening mechanism includes a rod member having a first end secured to the wedge and a second end extending through the bracket, the second end of said rod member including a tightening mechanism to shorten the effective length of the rod member.

14. The clamp according to claim 13, wherein a) the second end of the rod member is threaded; and b) said tightening mechanism is a thumb nut secured to the second end of said rod member.

15. The clamp according to claim 14, wherein said wedge includes, a) a first pin secured to the wedge at a first end of the first pin and a second end of the first pin being slidably contained within the grasping sleeve, and, b) a second pin secured to the wedge at a first end of the second pin and a second end of the second pin being slidably contained by the grasping sleeve.

* * * * *